US006989499B2

(12) United States Patent
Bortolloni et al.

(10) Patent No.: US 6,989,499 B2
(45) Date of Patent: Jan. 24, 2006

(54) MODULAR DISCONNECT SWITCH

(75) Inventors: Sergio Bortolloni, Sesto San Giovanni (IT); Giuseppe Zanaglio, Paderno Dugnano (IT); Miriam Biagini, Saronno (IT); Massimo Baldo, Paderno Dugnano (IT); Karen Hecht, Shorewood, WI (US); Theodore J. Houck, III, Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 10/812,704

(22) Filed: Mar. 30, 2004

(65) Prior Publication Data

US 2005/0224323 A1 Oct. 13, 2005

(51) Int. Cl.
*H01H 9/20* (2006.01)

(52) U.S. Cl. ..... 200/50.05; 200/329; 200/43.11

(58) Field of Classification Search .. 200/50.01–50.09, 200/50.11–50.17, 50.06, 329, 43.01, 43.02, 200/43.11–43.17, 43.19, 43.22, 43.08, 43.09, 200/330–339, 318, 321–2
See application file for complete search history.

(56) References Cited

U.S. PATENT DOCUMENTS

| | | | | |
|---|---|---|---|---|
| 1,376,813 | A * | 5/1921 | Horton | 200/43.11 |
| 1,404,865 | A * | 1/1922 | Kries | 200/17 R |
| 1,417,920 | A * | 5/1922 | Jessen | 200/50.07 |
| 1,986,221 | A * | 1/1935 | Sachs | 200/50.1 |
| 2,053,997 | A * | 9/1936 | Krcek | 200/50.07 |
| 4,851,621 | A | 7/1989 | Borchardt et al. | |
| 5,288,958 | A * | 2/1994 | Grunert et al. | 200/331 |
| 5,452,201 | A * | 9/1995 | Pieronek et al. | 700/83 |
| 5,463,196 | A * | 10/1995 | Darimont | 200/43.16 |
| 5,493,084 | A * | 2/1996 | Whitaker et al. | 200/50.05 |
| 5,609,244 | A * | 3/1997 | Reiter | 200/43.11 |
| 6,700,081 | B1 | 3/2004 | Houck, III | |
| 6,710,697 | B1 | 3/2004 | Houck, III | |
| 2004/0099515 | A1 | 5/2004 | Houck, III | |

FOREIGN PATENT DOCUMENTS

| | | |
|---|---|---|
| EP | 0 774 766 | 5/1997 |

OTHER PUBLICATIONS

Rockwell Automation, "A New Direction 194R NFPA 79 Compliant Solutions, 194RF/194RS/194RC Selection Guide," Publication 194RF-SG001A-EN-P, Jun. 2003, pp. 1-9.

Rockwell Automation, "1790 CompactBlock LDX I/O Blocks," http://www.ab.com/catalogs/b113/io/1790.html dated Nov. 18, 2003, pp. 1-6.

Rockwell Automation, "DeviceLogix Technology Higher Peformance with Lower-Cost Distributed Control," http://www.ab.com/devicelogix/ dated Nov. 18, 2003, pp. 1-2.

* cited by examiner

*Primary Examiner*—Lincoln Donovan
*Assistant Examiner*—M. Fishman
(74) *Attorney, Agent, or Firm*—Quarles & Brady LLP; Alexander M. Gerasimow

(57) ABSTRACT

The invention relates to a modular disconnect switch (10) for use in an electrical enclosure cabinet (26) having a plurality of different operating mechanisms that can be assembled with the switch. These include, but are not limited to: a dial-type ratcheting rotary switch with a door-sensitive actuating mechanism (40), a dual rotary switch (30) that meets certain standards and provides a butterfly handle inside the cabinet, a lock accessory (60) for enabling the lockout of the switch in the off position, a motion translator device (50) for interfacing to a side-mounted cabinet door handle, a network connectivity module (70), and a module for adding at least one switch pole to the basic disconnect switch (10).

13 Claims, 6 Drawing Sheets

11
80
81
L3
L2
L1
53
52
51
F3
F2
F1
56
55
54
92
83
OPT01
OPT02
OPT03
OPT04
OPT05
OPT06
75
70
LOGIC CIRCUIT
97
96
95
24V+
DATA(H)
DATA(L)
24V-

MODULAR DISCONNECT SWITCH

CROSS-REFERENCE TO RELATED APPLICATIONS

NOT APPLICABLE

STATEMENT REGARDING FEDERALLY SPONSORED RESEARCH

NOT APPLICABLE

TECHNICAL FIELD

The field of the invention is fused and non-fused disconnect switches of the type used in enclosures for electrical control equipment.

BACKGROUND ART

In factory automation and other commercial applications requiring control of motors and other electrical equipment, it is typical to mount electrical controls in a cabinet-styled enclosure. A door handle interlock mechanism is provided, so that when the door handle is operated to open the cabinet door and access the electrical control equipment, power is turned off. In particular, power to the other devices in the cabinet is supplied through a fused or non-fused disconnect switch. This switch may have multiple circuits or poles to handle polyphase voltages which may be supplied to the electrical equipment.

Once the cabinet has been opened, it may be desirable for service operations to again apply power to the devices in the cabinet. In the past, this was accomplished through certain types of methods for overriding the door interlock switch.

New standards have required that an on-off switch be provided in the interior of the cabinet for maintaining a locked-out "off" condition of the disconnect switch when the door of the enclosure is open. The standards also require that the switch be operable by qualified persons, independent of door position, and that in order to be switched to an "on" condition with the door open, the switch should require a deliberate action of the qualified person. The switch should also be capable of compatibility with various door interlock mechanisms available now and in the future.

Customers and applications require disconnect switches that can be provided in different configurations (e.g., with different numbers of poles, with front or side-operated switches, with rotary switch handles that are compliant with applicable standards, with or without lockout capability, and with or without network connectivity).

Customers prefer those disconnect switches which can be easily and quickly selected and assembled to satisfy their specifications. Such switches provide for high flexibility and a reduction in inventory costs. Network connectivity provides for faster diagnostics and servicing of the equipment at lower cost.

SUMMARY OF THE INVENTION

The invention relates to a modular disconnect switch for use in electrical enclosure cabinets having a plurality of different operating mechanisms that can be assembled with the switch.

These include, but are not limited to: a rotary switch with a door-sensitive coupling mechanism, a rotary switch that inside the cabinet that requires a two-part deliberate action for actuation, a lockout accessory for enabling the lockout of the switch in the off position, a motion translator device for interfacing to a side-mounted cabinet door handle, a network connectivity module, and modules for adding switch poles to the basic disconnect switch.

These accessories are made as modules that are interchangeable with other modules in the group through common interfaces. A first interface for various switching accessories is provided by a socket which is part of the mechanism for actuating and de-actuating the switch contacts. A second interface is provided for electrical and mechanical connection to switch modules which can be added to the basic three-pole switch body.

It is one object of the invention to provide several types of rotary switches that are installed inside the electrical enclosure to apply or disconnect power.

It is another object of the invention to provide a disconnect switch system that can be easily specified in different configurations.

It is another object of the invention to provide components that can be easily and quickly assembled to the basic disconnect switch.

It is another object of the invention to provide for network connectivity.

These and other objects and advantages of the invention will be apparent from the description that follows and from the drawings which illustrate embodiments of the invention, and which are incorporated herein by reference.

DETAILED DESCRIPTION

Figure 1:
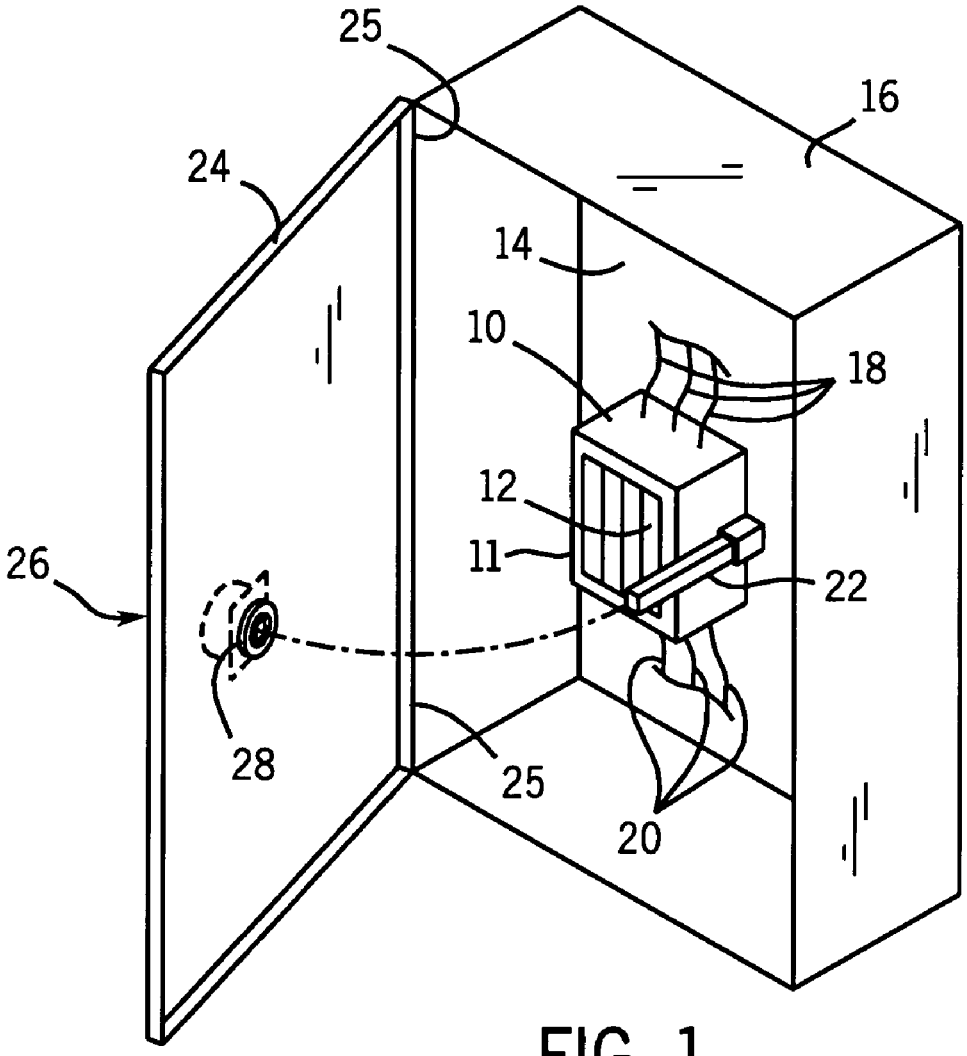
FIG. 1 is a perspective, generalized view of a disconnect switch installed in an electrical enclosure with one of the modular accessories of the present invention.

FIG. 1 illustrates a disconnect switch 10 which is mounted in the interior of an enclosure 26 with other electrical control equipment (not shown), such as relays, contactors and motor starters, to control the connection of electrical power to items inside the enclosure 26. The cabinet enclosure 26 includes a door 24 mounted by top and bottom hinges 25 to the cabinet body 16, for opening and closing a frontal access opening into a cabinet body 16. The disconnect switch 10 receives switch contact cartridges 12, which can include fuses and which be inserted in a supporting body 11 for the disconnect switch. The electrical power is typically three-phase power and the disconnect switch 10 has at least three fuse cartridges 12*a*, 12*b*, 12*c* (FIG. 2) corresponding to the three switch poles or sub-circuits. The switch 10 is rated for three-phase operation, although single-phase operation is also possible.

Electrical power is received through one set of input lines 18 in FIG. 1 connecting to input terminals along the top of the disconnect switch 10. From there, power is routed to the fuse cartridges 12*a*–12*c*. Output lines 20 (FIG. 1) are connected to output terminals along the bottom of the disconnect switch 10, to conduct power to the other equipment in the cabinet.

A handle 28 on the front of the door 24 in FIG. 1 is coupled through a shaft 22 to operate the actuating mechanism of the switch 10. The disconnect switch 10 and its contacts are closed or "ON", when the door 24 of the enclosure 10 is closed and the handle 28 is in the closed and locked position. When the door handle 28 is moved to a fully "open" position, to open the door 24 of the enclosure, the actuating mechanism in the switch 10 will have been moved to open the contacts, so that power to the cabinet is disconnected. This is a simplified explanation of the operation of the door handle 28, for the purpose of the present invention. A more complex opening sequence may be employed, but it forms no part of the present invention.

Figure 2:
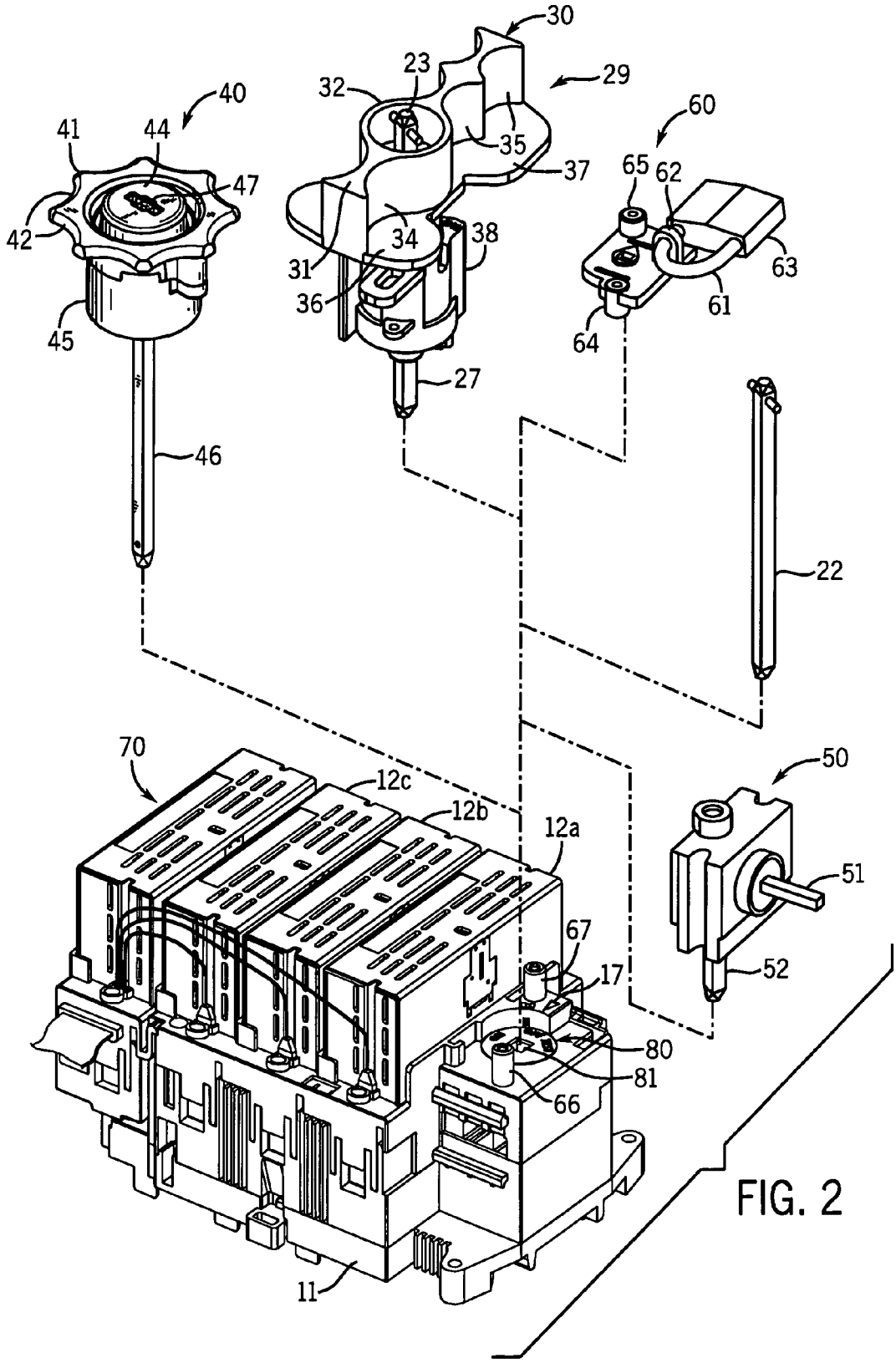
FIG. 2 is an exploded, detail perspective view of the disconnect switch of the present invention.

Referring to FIG. 2, the disconnect switch 10 has an actuating mechanism 80 with three positions, "ON", "OFF" and "TEST", as shown by the legends FIG. 2. In the "OFF" position, (with the "OFF" legend opposite reference indicator 17), the switch contacts in the disconnect switch are open and power is disconnected from the equipment in the cabinet 26. When the mechanism 80 is rotated ninety degrees clockwise to the "ON" position, (moving the "ON" legend in FIG. 2 into alignment with the reference indicator 17), the rotational action is translated to a rotational member (not shown) extending transversely in relation to the switch cartridges 12*a*–12*c* and when this member is moved, the switch contacts (S1–S6 in FIG. 4) are closed with a snap action. This mechanism 80 is known from prior disconnect switches and is not part of the present invention.

The disconnect switch 10 of the present invention is provided in sizes with ratings of sixty (60) amps, thirty (30) amps and smaller. A switch actuating mechanism for this use must be capable of transmitting sufficient torque to open and close the disconnect switch with the snap action typical in such switches. The torque required to actuate and de-actuate a 30-amp disconnect switch is 20 inch-lbs., while the torque required to actuate and de-actuate a 60-amp disconnect switch is 40 inch-lbs.

Once the cabinet 26 has been opened (FIG. 1), it may be desirable for service operations to again apply power to the devices in the cabinet 26. In the past, this was accomplished through certain types of methods for overriding the door interlock handle 28 and interlock shaft 22.

New standards from a U.S. standards organization have required that an on-off switch handle be provided in the interior of the cabinet for maintaining a locked-out and "OFF" condition of the disconnect switch 10 when the door 24 of the enclosure 26 is open. The standard requires that the switch assembly be operable by qualified persons, independent of door position, and that in order for the disconnect switch 10 to be switched to an "ON" condition with the door 24 open, the switch assembly should require a deliberate action of the qualified person. The switch assembly should also be capable of compatibility with various door interlock mechanisms available now and in the future.

Referring to FIG. 2, a rotary switch assembly 29 can be installed inside an electrical enclosure 26 on a switching interface 81 of an actuating mechanism 80 of the disconnect switch 10 to control actuation and de-actuation of the disconnect switch contacts through a two-part movement, first, in an axial direction, and then, in a rotational direction.

The switch assembly 29 includes a butterfly handle 30, (FIG. 2) which is formed symmetrically along a central rib 31 with two wings extending in opposite axial directions from a central hub 32. A first grip is formed by a first groove 34 for a thumb along a first side of the rib 31 and grooves for two opposing fingers (like grooves 35) along an opposite side of central rib 31 for turning the handle 30 in one direction around its central pivot. The second grip is formed by a groove for a thumb on the opposite side from first groove 34, and by grooves 35 for two opposing fingers on the first side of the central rib 31 for turning the handle 30 in an opposite rotational direction about its central pivot. Rests 36, 37 are formed to extend laterally from the bottom of the rib 31 to support the thumb an forefingers placed in grooves 34, 35. The rotary handle 30 therefore forms a first grip for gripping and rotating the handle 30 in one rotational direction and a second grip formed for gripping and turning the handle 30 in an opposite rotational direction.

The handle 30 is installed on a shorter shaft 23 of non-circular cross section that fits through an aperture in hub 32. The non-circular cross section allows application of torque without the handle 30 slipping on the shaft 22. The lower end of the shaft 23 is received in the rotor of a switching mechanism 38 that also receives an upper end of the shaft 27, which is received in an aperture of a switching interface 81 in a main actuating mechanism 80 (FIG. 2) for the disconnect switch 10. The switching interface 81 includes the aperture and a top surface of a rotatable part of the actuating member 80. This is called a "split-shaft" arrangement, which allows coupling to the actuating mechanism 80 when the switch assembly 29 is moved to the "ON" position and de-coupling from the disconnect switch actuating mechanism, when the handle 30 is in the "off" position.

This switch assembly 29 also provides a mechanism that requires that a person apply a first force axially inward and then a second force in a rotational direction, preferably at least a quarter turn, to move the switch to the "ON" position. This two-step operation requires a deliberate action and avoids inadvertent switch actuations. For a further description of this switch assembly, reference is made to a copending application of Bortolloni et al., entitled "Rotary Service Switch for the Interior of Electrical Enclosures having a Disconnect Switch," filed on even date herewith, the disclosure of which is incorporated herein by reference.

FIG. 2 also shows a view of a second rotary switch assembly 40 which is disclosed in U.S. patent application Ser. No. 10/714,433 filed on Nov. 14, 2003, and entitled "Fuse Block with Door Sensing Rotary Disconnect" The disclosure therein is hereby incorporated by reference. This rotary switch assembly 40 has a dial-type handle provided by a scalloped ring 41 for rotation in either direction and a door-sensitive button 44 which is released by the opening of the enclosure door to prevent the switch from being operated without further operator actions such as, 1) depressing the button 44 or 2) pulling up on the scalloped ring 41, which has grooves 42 for receiving the fingers of an operator. These actions allow a ratcheting mechanism in the interior of a hub 45 for the switch assembly to couple the rotation of the ring 41 in either direction to the shaft 46. This shaft 46 is received in opening of the switching interface 81 in the disconnect switch operating mechanism 80.

The button mechanism 44 further includes a keyway 47 that receives a shaft and pin coupling the mechanism to the door handle 28 seen in FIG. 1, such that the operating shaft 46 and hub 45 can rotate in concert with the door handle 28 when the door 24 is closed. When the door 24 is opened, the shaft (not shown) is pulled out of the keyway 47 to disconnect the door handle 28 from the rotary switch 40, with the rotary switch 40 remaining in position to operate the disconnect switch 10. The button mechanism 44 is springloaded and can thus be depressed with respect to hub 45 when door 24 is closed to re-couple the mechanism to door handle 28.

For additional details of construction, reference is made to U.S. patent application Ser. No. 10/714,433 filed on Nov. 14, 2003, and entitled "Fuse Block with Door Sensing Rotary Disconnect," cited above.

It is also possible to provide a rotary switch on a side of the cabinet enclosure 26. In this configuration, a third switching assembly comprising a motion translator switching assembly 50 on the switching interface 81 for translating a rotary motion from a rotary switch on the side of the cabinet through a horizontal shaft 51 to a depending shaft 52 that couples the assembly 50 to switch actuating mechanism 80. The motion translator 50 uses gears or other well known mechanical devices for translation motion between two shafts 51, 52 having axes of rotation that are orthogonal (ninety degrees apart).

Another modular assembly is provided by a lockout assembly 60 that is installable on the switching interface 81 with a holed lockout tab 62 that will receive the shackle 61 of a padlock 63 to lockout the switch actuating mechanism in the "off" position. Screws (not shown) are inserted through mounting bosses 64, 65 into bosses 66, 67 on the switch body 11 to hold the lockout assembly 60 in place on the actuating mechanism.

Figure 5:
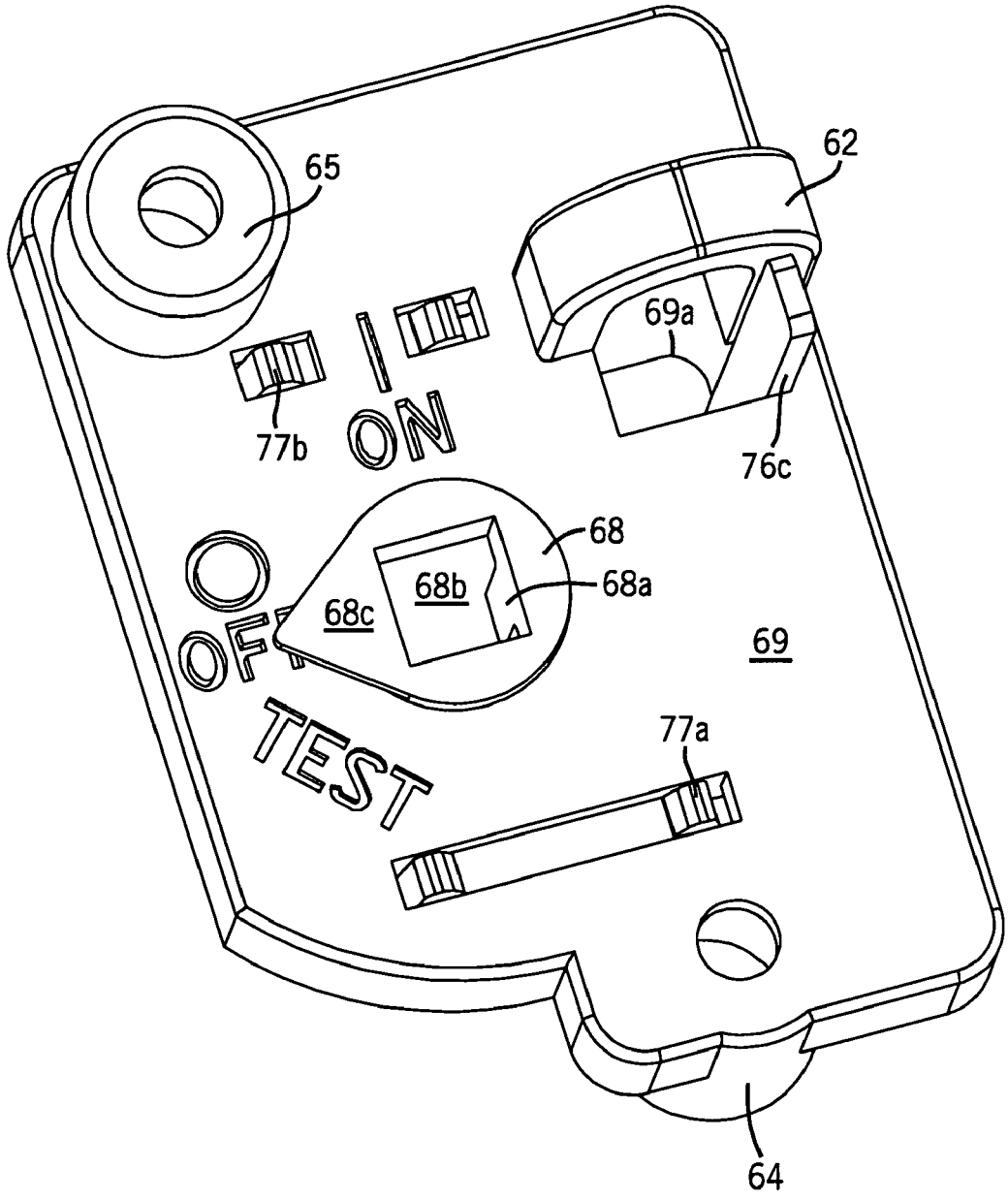
FIG. 5 and is a perspective assembly view of a lockout assembly, which is one of the accessories in FIG. 1.
Figure 6:
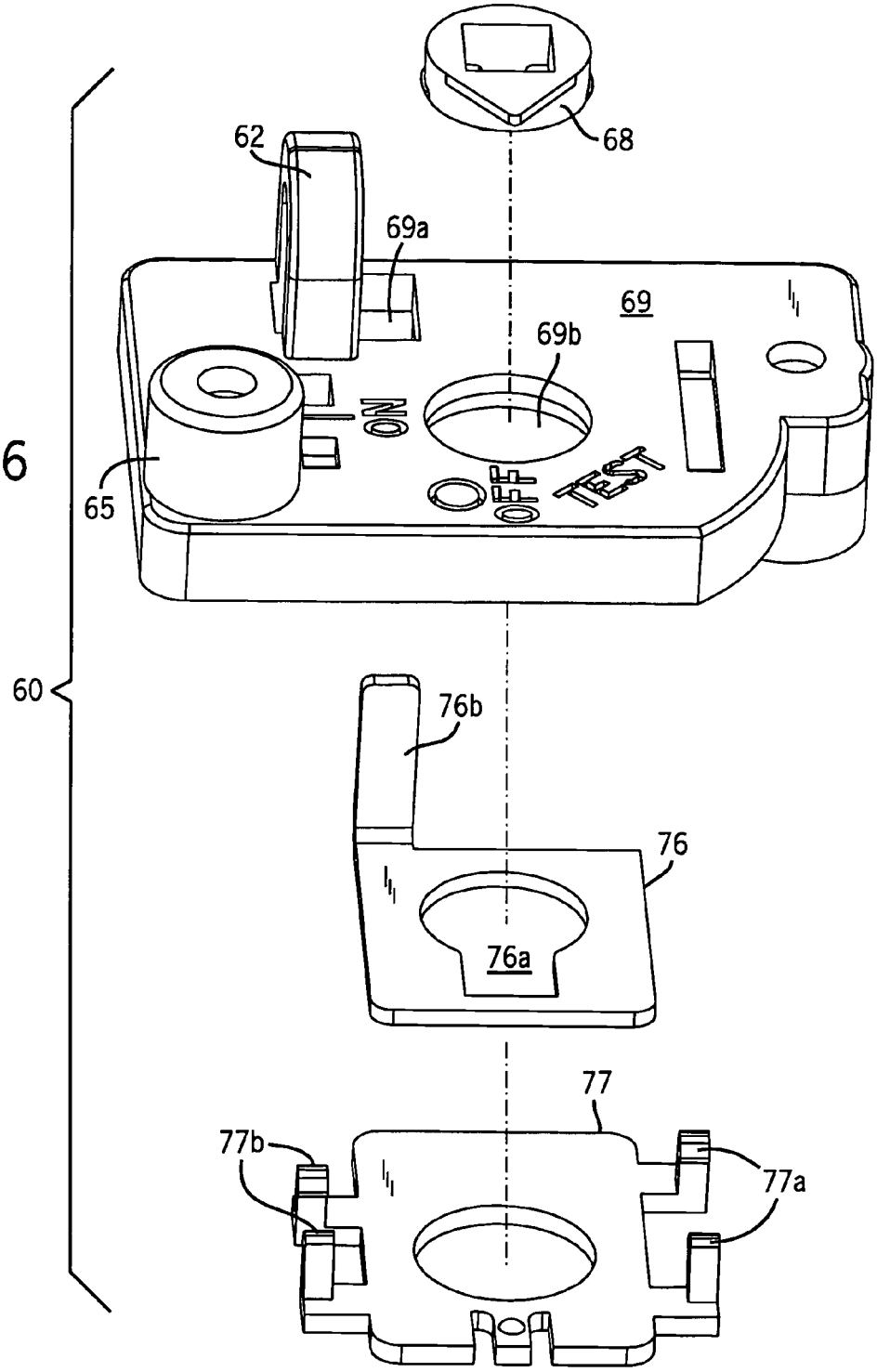
FIG. 6 is an exploded view of the assembly of FIG. 5.

The details of this assembly 60 are seen in FIGS. 5 and 6. A base 69 has a generally central aperture 69*b* for passage of the switch shaft 22, 27, 46, 52. An aperture 69*a* is provided near the lockout tab 62 for receiving a finger 76*b* which is part of a slider member 76 seen in FIG. 6. The slider member 76 has an opening 76*a* with a notch portion for fitting around the square shaft 22, 27, 46, 52 and preventing it from rotating. The notch is in that position when the finger 76*b* is in the position seen in FIG. 5. If a lock shackle is placed through the tab 62, the finger 76*c* and member 76 cannot be moved to release the shaft into the wider part of the opening 76*a*. A bottom retaining member 77 has locking tabs 77*a* and 77*b* for reception in openings in the base 69 to hold the three pieces 69, 76 and 77 together. The dial operator 68 fits into the opening 69*b* and has a tab 68*a* that engages in square opening in the switch operator 80 in FIG. 2 and will rotate the switch operating mechanism 80 unless the switch operating shaft switch shaft 22, 27, 46, 52 is locked against movement. The dial 68 has a pointed indicator 68*c* for indicating, which position it is in based on its position corresponding with the legends, "ON," "OFF," and "TEST," seen on the lockout base member 69 in FIG. 5.

Another possible assembly, which is individually known in the art, an extension shaft 22 for insertion into the opening of the switching interface 81 of actuating mechanism 80 and for coupling to a door-mounted handle 28 for actuating and de-actuating the disconnect switch contacts as shown in FIG. 1.

Figure 3:
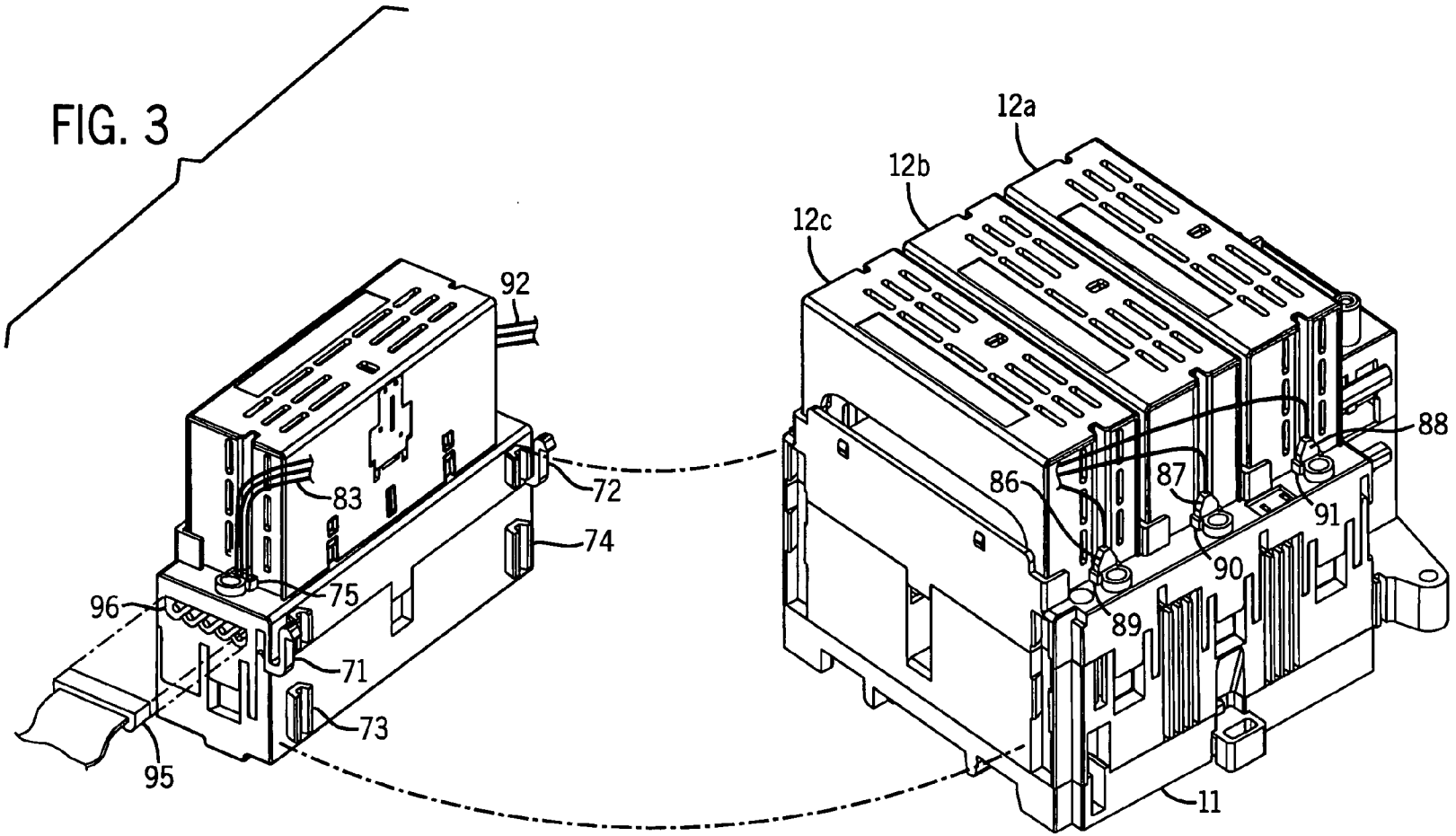
FIG. 3 is a partially exploded perspective view of a network connectivity module included in the disconnect switch of FIG. 1.
Figure 4:
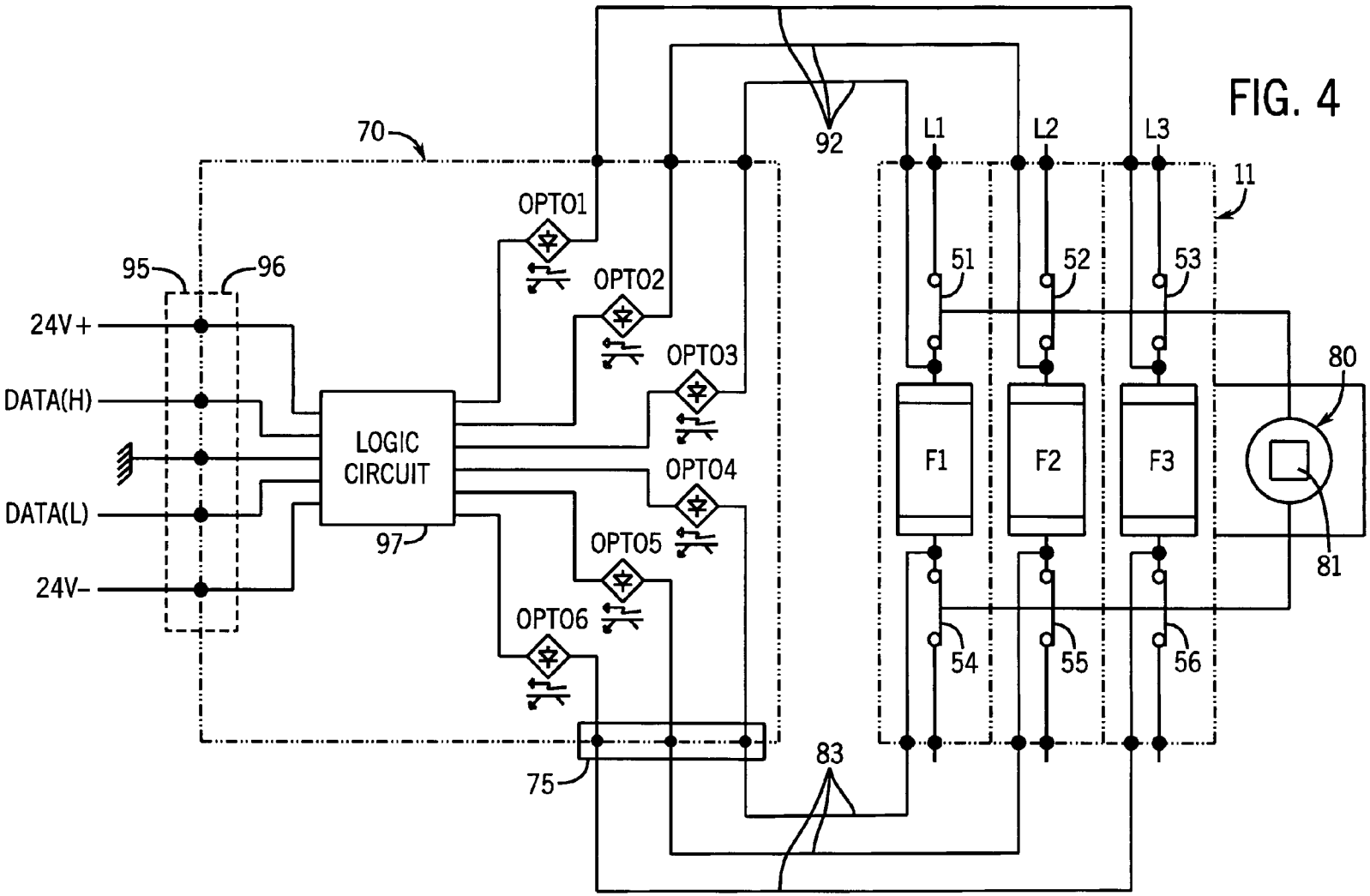
FIG. 4 is an electrical schematic view of the disconnect switch of FIG. 3 including the network connectivity module.

FIGS. 2, 3 and 4 illustrate a network connectivity module 70 that is attached to the one side of a disconnect switch 10 having three fuse cartridges 12*a*, 12*b* and 12*c* mounted on a switch body 11. As seen in FIG. 3, this module has flexible hooked fingers 71, 72 and flexible channel connectors 73, 74 for snapping in grooves in the switch body 11 housing supporting switch cartridge 12*c*.

External electrical connections are provided by three wires 83 that extend through a network port 75 on the module to plugs 86, 87 and 88 which are received in sockets 89, 90 and 91 on the switch modules 12*a*, 12*b* and 12*c*. Another set of three wires 92 extending through a network port on an opposite side of the network connectivity module 70 to connections (not shown) on the top side of the switch 10. A five-socket network connector 95 plugs into a five-pin connector 96 on the network connectivity module 70.

FIG. 4 shows a schematic of the switch 10 including the network connectivity module 70. In the switch body 11, the fuses F1–F3 are connected through switches S1–S6 on either side to power lines L1, L2 and L3. The switch actuating mechanism 80 is coupled to the switches Sl–S6. Sensing lines 83 and 92 are connected between the switches S1–S6 and the fuses F1–F3 to sense the state of the fused circuits. In a switch without fuses, the lines would sense the on-off state of the circuits controlled by switches S1–S6. The sensing lines 83 and 92 connect to the network connectivity module 70 through the ports mentioned above.

On board the network connectivity module 70, the lines are then connected to opto-isolator circuits OPTO1–OPT06, which are then connected to inputs on a logic circuit 97. This circuit 97 may be a processor-based circuit or non-processor-based logic circuit for converting the status signals from the fuses F1–F3 to data, which can then be transmitted through the network connectivity port 95, 96 over a DeviceLogix™ network or other suitable network to report the conducting or non-conducting state of the fuses. The five line port includes two lines for the 24-volt dc power supply, a line for ground and two data lines, DATA (H) and DATA (L).

The ability to add this module 70 to the switch 10, with a form factor similar to the fuse modules 12*a*, 12*b*, 12*c* enhances the functionality and versatility of the modular switch assembly. The network connectivity module 70 has substantially the same form factor as the fuse modules 12*a*, 12*b*, and 12*c*, the differences being provided by connectors 71, 72, 73, 74 and 96 described above.

A switch module can be added with switch contacts for at least one additional switch pole and a fuse, and with the switch module being connected to the switch actuating mechanism for the disconnect switch 10. The switch module would have a housing with a base and a fuse cover similar to those seen for the network connectivity module 70.

This has been a description of several preferred embodiments of the invention. It will be apparent that various modifications and details can be varied without departing from the scope and spirit of the invention, and these are intended to come within the scope of the following claims.

What is claimed is:

1. A disconnect switch for installation in an electrical enclosure having a door with a door handle, the switch comprising:

at least three switch poles, each switch pole having at least one pair of switch contacts;

a switch actuating mechanism for actuating and de-actuating the disconnect switch contacts;

a switching interface coupled to the switch actuating mechanism for receiving a selected switching assembly;

a first switching assembly that is installable on the switching interface, the switching assembly having a switch handle extending in opposite directions from a pivot for rotation in either rotational direction for actuating and de-actuating the disconnect switch contacts, respectively, the switch handle also being axially pressed inward prior to rotation, to effect actuation of the switch contacts; and a second switching assembly that is installable on the switching interface as an alternative to the first switching assembly, the second switching assembly having a rotary mechanism that is coupled to the door handle when the door is closed and which is available when the door is opened to be rotated in either direction to actuate and de-actuate the disconnect switch contacts.

2. The disconnect switch of claim 1, further comprising a third switching assembly comprising a motion translator switching assembly that is installable on the switching interface, as an alternative to the first switching assembly and the second switching assembly, to couple the rotary motion from a rotary switch on a side of the enclosure to a shaft extending from the switching interface toward the door of the enclosure.

3. The disconnect switch of claim 1, further comprising a third assembly comprising a lockout assembly that is installable on the switching interface as an alternative to the first switching assembly and the second switching assembly, said third switching assembly be operable to lockout the switch actuating mechanism.

4. The disconnect switch of claim 1, further comprising a third assembly comprising an extension shaft for coupling to a door-mounted switch for actuating and de-actuating the disconnect switch contacts.

5. A disconnect switch for installation in an electrical enclosure having a front door, the switch comprising:

at least three switch poles, each switch pole having at least one pair of switch contacts;

a switch actuating mechanism for actuating and de-actuating the disconnect switch contacts;

a switching interface coupled to the switch actuating mechanism for receiving a selected switching assembly;

a first switching assembly that is installable on the switching interface, the switching assembly comprising a motion translator switching assembly that is installable on the switching interface to couple a rotary motion from a rotary switch on a side of the enclosure to a shaft extending from the switching interface toward the front door of the enclosure; and a second switching assembly that is installable on the switching interface as an alternative to the first switching assembly, the second switching assembly having a button mechanism that is pressed axially inward to allow the switching assembly to be rotated in either direction and also has a handle that can be gripped and pulled outwardly to allow the switching assembly to be rotated in either direction to actuate and de-actuate the disconnect switch contacts.

6. The disconnect switch of claim 5, further comprising a third switching assembly having a handle extending in opposite directions from a pivot for rotation in either rotational direction for actuating and de-actuating the disconnect switch contacts, respectively, the handle also being axially pressed inward prior to rotation, to effect actuation of the switch contacts.

7. The disconnect switch of claim 5, further comprising a third assembly comprising a lockout assembly that is installable on the switching interface to lockout the switch actuating mechanism.

8. The disconnect switch of claim 5, further comprising a third assembly comprising an extension shaft for coupling to a door-mounted switch for actuating and de-actuating the disconnect switch contacts.

9. A disconnect switch for installation in an electrical enclosure, the switch comprising:

a switch body;

at least three switch modules, each switch module having at least one pair of switch contacts and a fuse and having at least a portion that is detachable from the switch body, the three switch modules each having a same form factor;

a switch actuating mechanism for actuating and de-actuating the disconnect switch contacts in said three switch modules;

a fourth switch module for attachment to the switch body, the fourth switch module having substantially the same form factor as any one of the three switch modules and having a network connector for connection of the disconnect switch contacts to a network and having mechanical and electrical connectors which connect to at least one of the three switch modules to connect the switch modules to a network for sensing an on-off status of switching circuits provided by the switch contacts in the disconnect switch.

10. The disconnect switch of claim 9, further comprising:

a switching interface coupled to the switch actuating mechanism for receiving a selected switching assembly; and a first switching assembly that is installable on the switching interface, the switching assembly having a handle extending in opposite directions from a pivot for rotation in either rotational direction for actuating and de-actuating the disconnect switch contacts, respectively, the handle also being axially pressed inward prior to rotation, to effect actuation of the switch contacts; and a second switching assembly that is installable on the switching interface as an alternative to the first switching assembly, the second switching assembly having a button mechanism that is pressed axially inward to allow the switching assembly to be rotated in either direction and also has a handle that can be gripped and pulled outwardly to allow the switching assembly to be rotated in either direction to actuate and de-actuate the disconnect switch contacts.

11. The disconnect switch of claim 10, further comprising a third switching assembly comprising a motion translator switching assembly that is installable on the switching interface to couple a rotary motion from a rotary switch on a side of the enclosure to a shaft extending from the switching interface toward the door of the enclosure.

12. The disconnect switch of claim 10, further comprising a third assembly comprising a lockout assembly that is installable on the switching interface to lockout the switch actuating mechanism.

13. The disconnect switch of claim 10, further comprising a third assembly comprising an extension shaft for coupling to a door-mounted switch for actuating and de-actuating the disconnect switch contacts.

* * * * *